US006540008B1

(12) United States Patent
Meyer et al.

(10) Patent No.: US 6,540,008 B1
(45) **Date of Patent: *Apr. 1, 2003**

(54) MOLTEN METAL INJECTOR SYSTEM AND METHOD

(75) Inventors: Thomas N. Meyer, Murrysville, PA (US); Michael J. Kinosz, Apollo, PA (US); Nicolas Bigler, Morin Heights (CA); Guy Arnaud, Rivière-Beaudette (CA)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/609,997

(22) Filed: Jul. 3, 2000

Related U.S. Application Data

(60) Provisional application No. 60/142,218, filed on Jul. 2, 1999, and provisional application No. 60/142,315, filed on Jul. 2, 1999.

(51) Int. Cl.[7] ..... B22D 17/04

(52) U.S. Cl. ..... 164/312; 164/306; 164/259

(58) Field of Search ..... 164/317, 315, 164/133, 113, 135, 306, 312

(56) References Cited

U.S. PATENT DOCUMENTS

| | | | | |
|---|---|---|---|---|
| 2,602,189 A | | 7/1952 | Finelt | 18/30 |
| 4,085,791 A | | 4/1978 | Kaiser | 164/305 |
| 4,262,742 A | * | 4/1981 | James | 166/112 |
| 4,502,524 A | * | 3/1985 | Iwanami et al. | 164/100 |
| 4,862,945 A | | 9/1989 | Greanias et al. | 164/63 |

(List continued on next page.)

FOREIGN PATENT DOCUMENTS

| | | | |
|---|---|---|---|
| BE | 446116 | * | 6/1942 |
| DE | 1458001 | | 12/1968 |
| EP | 0381486 | | 1/1990 |
| JP | 7284904 | * | 10/1995 |
| SU | 549254 | | 3/1977 |

OTHER PUBLICATIONS

Patent Abstracts of Japan; Publication No. 07284904, Publication date Oct. 31, 1995; Application date Apr. 21, 1994.

Application No. 06082886; entitled "Stoke for Differential Pressure Casting" Applicant Hitachi Metals Ltd; Inventor—Onishi Sanetsugu.

*Primary Examiner*—M. Alexandra Elve
*Assistant Examiner*—Kevin McHenry
(74) *Attorney, Agent, or Firm*—Webb Ziesenheim Logsdon Orkin & Hanson, P.C.

(57) ABSTRACT

Disclosed is a molten metal injector system including a holder furnace, a casting mold supported above the holder furnace, and a molten metal injector supported from a bottom side of the mold. The holder furnace contains a supply of molten metal having a metal oxide film surface. The bottom side of the mold faces the holder furnace. The mold defines a mold cavity for receiving the molten metal from the holder furnace. The injector projects into the holder furnace and is in fluid communication with the mold cavity. The injector includes a piston positioned within a piston cavity defined by a cylinder for pumping the molten metal upward from the holder furnace and injecting the molten metal into the mold cavity under pressure. The piston and cylinder are at least partially submerged in the molten metal when the holder furnace contains the molten metal. The cylinder further includes a molten metal intake for receiving the molten metal into the piston cavity. The molten metal intake is located below the metal oxide film surface of the molten metal when the holder furnace contains the molten metal. A method of injecting molten metal into a mold cavity of a casting mold is also disclosed.

13 Claims, 6 Drawing Sheets

U.S. PATENT DOCUMENTS

| | | | | | |
|---|---|---|---|---|---|
| 4,961,455 | A | | 10/1990 | Redemske et al. | 164/147 |
| 4,967,827 | A | * | 11/1990 | Campbell | 164/133 |
| 4,991,641 | A | * | 2/1991 | Kidd et al. | 164/120 |
| 5,082,045 | A | | 1/1992 | Lambert | 164/113 |
| 5,181,551 | A | * | 1/1993 | Kidd et al. | 164/113 |
| 5,197,529 | A | | 3/1993 | Caugherty | 164/113 |
| 5,205,346 | A | * | 4/1993 | Kuhn et al. | 164/133 |
| 5,244,033 | A | | 9/1993 | Ueno | 164/312 |
| 5,370,171 | A | | 12/1994 | Fields et al. | 164/312 |
| 5,657,812 | A | | 8/1997 | Walter et al. | 164/113 |
| 5,725,043 | A | | 3/1998 | Schaefer et al. | 164/119 |
| 5,735,333 | A | | 4/1998 | Nagawa | 164/113 |
| 5,792,378 | A | * | 8/1998 | Christensen et al. | 164/457 |
| 5,979,534 | A | * | 11/1999 | Shibata et al. | 164/113 |

* cited by examiner

MOLTEN METAL INJECTOR SYSTEM AND METHOD

CROSS REFERENCE TO RELATED APPLICATIONS

This application claims the benefit of U.S. Provisional Application Serial Nos. 60/142,218, filed Jul. 2, 1999, and entitled "Molten Metal Injector System" and 60/142,315, filed Jul. 2, 1999, and entitled "Valveless Molten Metal Injector System".

STATEMENT REGARDING FEDERALLY FUNDED RESEARCH

The subject matter of this application was made with United States government support under Contract No. 86X-SU545C awarded by the Department of Energy. The United States government has certain rights to this invention.

BACKGROUND OF THE INVENTION

1. Field of the Invention

The present invention relates to a casting apparatus and to a method for producing ultra large, thin-walled components and, more particularly, to a molten metal injector system for producing ultra large, thin-walled components.

2. Description of the Prior Art

The manufacturers of ground transportation vehicles, such as automobiles, sport utility vehicles, light trucks, vans, buses and larger capacity trucks, have made major efforts in recent years to reduce vehicle weight. Weight reductions reduce harmful atmospheric emissions and increase fuel efficiency of ground transportation vehicles. Presently, a majority of the body components for ground transportation vehicles are formed from individual steel components that are assembled via resistance spot welding. For example, the floor pan frame of an automobile is normally constructed from a number of individual steel stampings that are spot welded together. It would be advantageous to produce body components for ground transportation vehicles, such as the floor pan frame of an automobile, as a single ultra large casting. As a result, the costs associated with producing multiple steel stampings and then assembling the stampings may be eliminated. The same technology would also be suitable for components in the aerospace industry.

There are several known methods for producing thin-walled castings. Examples include: high pressure cold chamber vacuum die casting, premium sand casting, a level pour process practiced by Alcoa, Inc. for producing components for the aerospace industry and low pressure hot chamber injection. Low pressure hot chamber injection is particularly well-suited for producing components made from non-ferrous metals having a low melting point, such as aluminum, brass, bronze, magnesium and zinc.

A typical casting apparatus and method known in the prior art for the casting of low melting point temperature metal materials is disclosed in U.S. Pat. No. 4,991,641 to Kidd et al. (hereinafter "the Kidd patent"). The Kidd patent discloses an apparatus that includes a supply tank configured to contain molten metal alloys and a cylinder in the tank having at its base a connection to an injection passageway that leads through the tank to a casting die located outside the tank. A piston reciprocates in the tank, which allows the molten metal alloy to be drawn into the cylinder and forced through the injection passageway to the casting die. A control system for the piston controls the speed of the piston in the cylinder when the molten metal alloy is fed to the casting die. Other similar prior art casting devices are disclosed in U.S. Pat. Nos. 5,082,045 to Lambert; 5,181,551 to Kidd et al.; and 5,657,812 to Walter et al. Each of the devices disclosed in the foregoing patents includes a reciprocating piston that injects molten metal into a mold cavity during the downstroke of the piston.

Piston arrangements such as those disclosed by the Kidd patent have several disadvantages. For example, the use of reciprocating pistons that inject molten metal to a casting die during the downstroke have a tendency to disturb the metal oxide film surface of the molten metal alloy contained in the supply tank. Consequently, undesirable metal oxides and/or air bubbles are often injected into the casting mold along with the molten metal alloy, thus resulting in an inferior casting. Even if the metal oxide film surface of the molten metal alloy is not substantially disturbed, metal oxides sometimes form in the piston cylinder during the downstroke of the piston.

Accordingly, it is an object of the present invention to provide an apparatus and method for the casting of inexpensive, thin-walled components. In addition, it is an object of the present invention to provide an apparatus and method for casting thin-walled components of such size and complexity that traditional stamping assemblies made from multiple stamped components could be replaced with a single, thin-walled component. Finally, it is an object of the present invention to generally overcome the deficiencies of the prior art such as those described herein in connection with the Kidd patent.

SUMMARY OF THE INVENTION

The above objects are accomplished with a molten metal injector system according to the present invention. The molten metal injector system of the present invention includes a holder furnace for containing a supply of molten metal having a metal oxide film surface. A casting mold is supported above the holder furnace and has a bottom side facing the holder furnace. The mold defines a mold cavity for receiving the molten metal from the holder furnace. A molten metal injector is supported from the bottom side of the mold and projects into the holder furnace. The injector is in fluid communication with the mold cavity and includes a piston positioned within a piston cavity defined by a cylinder for pumping the molten metal upward from the holder furnace and injecting the molten metal into the mold cavity under pressure. The piston and cylinder are at least partially submerged in the molten metal when the holder furnace contains molten metal. The cylinder further includes a molten metal intake for receiving the molten metal into the piston cavity. The molten metal intake is located below the metal oxide film surface of the molten metal when the holder furnace contains the molten metal.

The molten metal intake is preferably located sufficiently below the metal oxide film surface when the holder furnace contains molten metal such that the metal oxide film surface remains substantially undisturbed during pumping of the molten metal from the holder furnace to the mold cavity. The piston may be oriented substantially perpendicular to the bottom side of the mold and movable through a downstroke and a return stroke. The injector may further include a lifting mechanism positioned above the metal oxide film surface when the holder furnace contains the molten metal. The lifting mechanism is preferably operatively connected to the piston for moving the piston through the downstroke and the return stroke. The molten metal preferably flows through the molten metal intake and into the piston cavity during the downstroke of the piston when the holder furnace contains the molten metal. During the return stroke of the piston, the molten metal received in the piston cavity is preferably pumped upward from the holder furnace by the piston and injected into the mold cavity under pressure.

The molten metal intake may be a valve configured to open during the downstroke of the piston and permit inflow of the molten metal into the piston cavity such that metal oxides are substantially prevented from forming in the piston cavity. In addition, the molten metal intake may be a gap formed between the piston and a tapered inner surface of the cylinder at a substantially full downstroke position of the piston. Furthermore, the molten metal intake may be an aperture formed in a sidewall of the cylinder and connected to the piston cavity. The aperture may be open for inflow of the molten metal into the piston cavity when the piston is in the substantially full downstroke position. A molten metal filter may be used to cover the molten metal intake for filtering and removing debris from the molten metal flowing into the piston cavity through the molten metal intake.

The piston and the cylinder are preferably made of a material compatible with molten aluminum alloys. The lifting mechanism may be a rack and pinion. The piston cavity may be in fluid communication with the mold cavity through a fill tube passing through the bottom side of the mold. A source of inert gas may be in fluid communication with the fill tube such that during the downstroke of the piston, the piston cavity is filled with inert gas flowing down the fill tube for substantially preventing the formation of metal oxides in the cylinder.

The present invention is also a method of operating a molten metal injector in connection with a supply of molten metal and a casting mold having a mold cavity. The method preferably includes the steps of: providing the supply of molten metal; providing the molten metal injector, with the injector having a cylinder defining a piston cavity housing a reciprocating piston, with the cylinder including a molten metal intake for receiving molten metal from the supply of molten metal into the piston cavity, and with the piston movable through a downstroke and a return stroke by a lifting mechanism operatively connected to the piston; supporting the injector above the supply of molten metal such that the cylinder and piston are at least partially submerged in the supply of molten metal, and such that the molten metal intake lies completely submerged in the supply of molten metal; moving the piston through a downstroke with the lifting mechanism; permitting inflow of the molten metal from the supply of molten metal into the piston cavity through the molten metal intake during the downstroke of the piston such that the piston cavity is at least partially filled with the molten metal; moving the piston cavity through a return stroke with the lifting mechanism; and preventing the inflow of the molten metal from the supply of molten metal into the piston cavity with the molten metal intake during the return stroke of the piston.

The method according to the present invention may also include the steps of: locating casting mold above the supply of molten metal such that a bottom side of the casting mold faces the supply of molten metal; supporting the injector from the bottom side of the casting mold; and placing the piston cavity in fluid communication with the mold cavity such that during the return stroke of the piston the molten metal received in the piston cavity through the molten metal intake is injected into the piston cavity.

Further, the method according to the present invention may include the steps of: providing the molten metal intake as a valve having a valve controller operatively connected thereto for opening and closing the valve; opening the valve with the valve controller during the downstroke of the piston such that the valve permits the inflow of the molten metal from the supply of molten metal into the piston cavity; closing the valve with the valve controller during the return stroke of the piston such that the valve prevents the inflow of the molten from the supply of molten metal into the piston cavity. The method may further include the steps of: supplying inert gas to the piston cavity during the downstroke of the piston for preventing the formation of metal oxides in the piston cavity; and filtering the molten metal flowing into the piston cavity through the molten metal intake during the downstroke of the piston with a molten metal filter.

Further details and advantages of the present invention will become apparent from the following detailed description, in conjunction with the drawings, wherein like parts are designated with primed reference numerals.

DETAILED DESCRIPTION OF THE PREFERRED EMBODIMENTS

Figure 1:
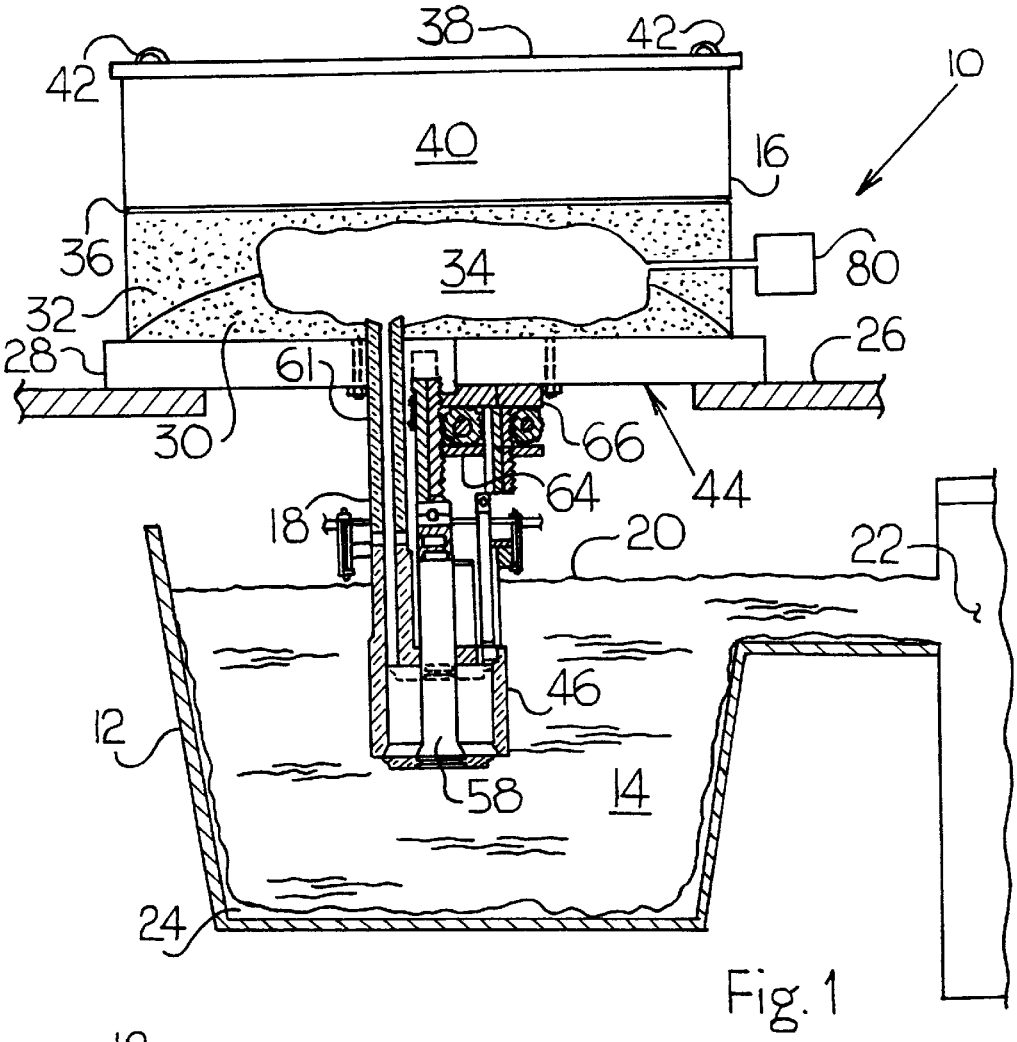
FIG. 1 is a partial cross-sectional side view of a molten metal injector system according to the present invention.
Figure 4:
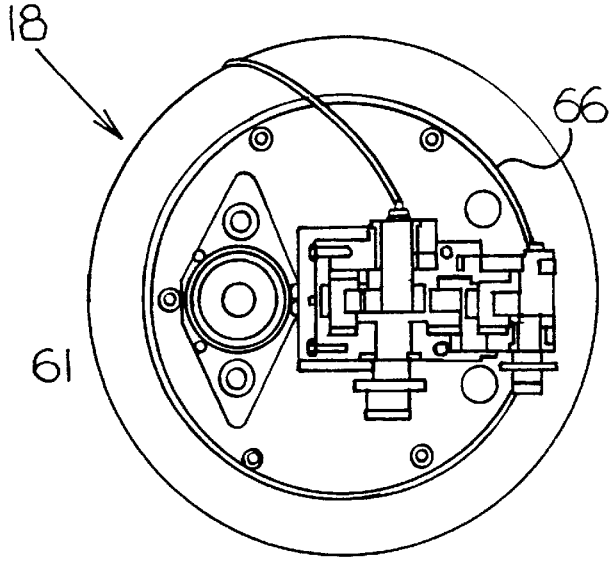
FIG. 4 is a top plan view of the injector of FIG. 2.

FIG. 1 shows a molten metal injector system in accordance with the present invention and designated with reference numeral 10. The injector system 10 generally includes a holder furnace 12 that contains a supply of molten metal 14, such as a molten aluminum alloy, a casting mold 16 positioned above the holder furnace 12, and at least one injector 18 supported from the casting mold 16. The molten metal 14 contained in the holder furnace 12 may be exposed to the atmosphere and a metal oxide film surface 20 will form at the top of the molten metal 14 contained in the holder furnace 12. Alternatively, the holder furnace 12 may further include a cover (not shown) such that the molten metal 14 is enclosed within the holder furnace 12. The holder furnace 12 is in fluid communication with a main melter furnace 22, which typically contains a large quantity of the molten metal 14 while the holder furnace 12 contains a much smaller quantity of molten metal 14. For example, the main melter furnace 22 may contain 30,000 pounds of the molten metal 14 while the holder furnace 12 may contain about 2,000 pounds of the molten metal 14. The main melter furnace 22 maintains a steady supply of the molten metal 14 to the holding furnace 12 during operation of the injector system 10. When the molten metal 14 is a containment-difficult molten metal, such as molten aluminum alloys, the holder furnace 12 is preferably lined with refractory material 24 such as Sigma or BETA II Castable refractory material products manufactured by Permatech.

The casting mold 16 is supported by a support surface 26, such as the floor of a structure. The casting mold 16 is configured for casting ultra large, thin-walled components such as those that may be used in ground transportation vehicles. An ultra large, thin-walled component part for a ground transportation vehicle may have dimensions approaching 3 meters long, 1.7 meters wide and 0.4 meters in depth, and the casting mold 16 will be configured accordingly. The casting mold 16 is preferably suitable for use with molten metal alloys having a low melting point, such as aluminum alloys. The casting mold 16 includes a holder frame 28 that is supported on the support surface 26. The support surface 26 is positioned a sufficient distance above the holder furnace 12 so that at least portions of the injector 18 lie above the metal oxide film surface 20 of the molten metal 14 contained in the holder furnace .12. For example, the support surface 26 and, hence, the casting mold 16 may be eighteen inches above the metal oxide film surface 20 of the molten metal 14 when the holder furnace 12 is filled with the molten metal 14. The casting mold 16 includes a lower die 30 and an upper die 32 which together define a mold cavity 34. A cover plate 36 is positioned on top of the upper die 32. A top clamp plate 38 is separated from the cover plate 36 by a spacer block 40. Hoist rings 42 are preferably attached to the top clamp plate 38 for mold removal and installation. A bottom side 44 of the casting mold 16 faces the holder furnace 12.

In a preferred embodiment of the present invention, a plurality of the injectors 18 is supported from the bottom side 44 of the casting mold 16 and project downward into the holder furnace 12. However, in FIG. 1 only one injector 18 is shown for clarity and expediency in explaining the present invention. The use of multiple injectors 18 to cast an ultra large, thin-walled component will be discussed herein with reference to FIGS. 7–9.

FIGS. 1–4 show the details of the injector 18 according to a first embodiment of the present invention. The injector 18 includes a cylinder 46 for submerging in the molten metal 14 contained in the holder furnace 12. The cylinder 46 defines a piston cavity 48 and a fill conduit 50 in fluid communication with the piston cavity 48. The cylinder 46 includes a lower end 52 that is submerged in the molten metal 14 contained in the holder furnace 12 when the holder furnace 12 is filled with the molten metal 14. At the lower end 52 of the cylinder 46, the cylinder 46 defines a tapered inner surface 54. In particular, the tapered inner surface 54 is formed at the lower end 52 of the cylinder 46. The cylinder 46 includes a sidewall 56 having an inner surface 57.

Figure 2:
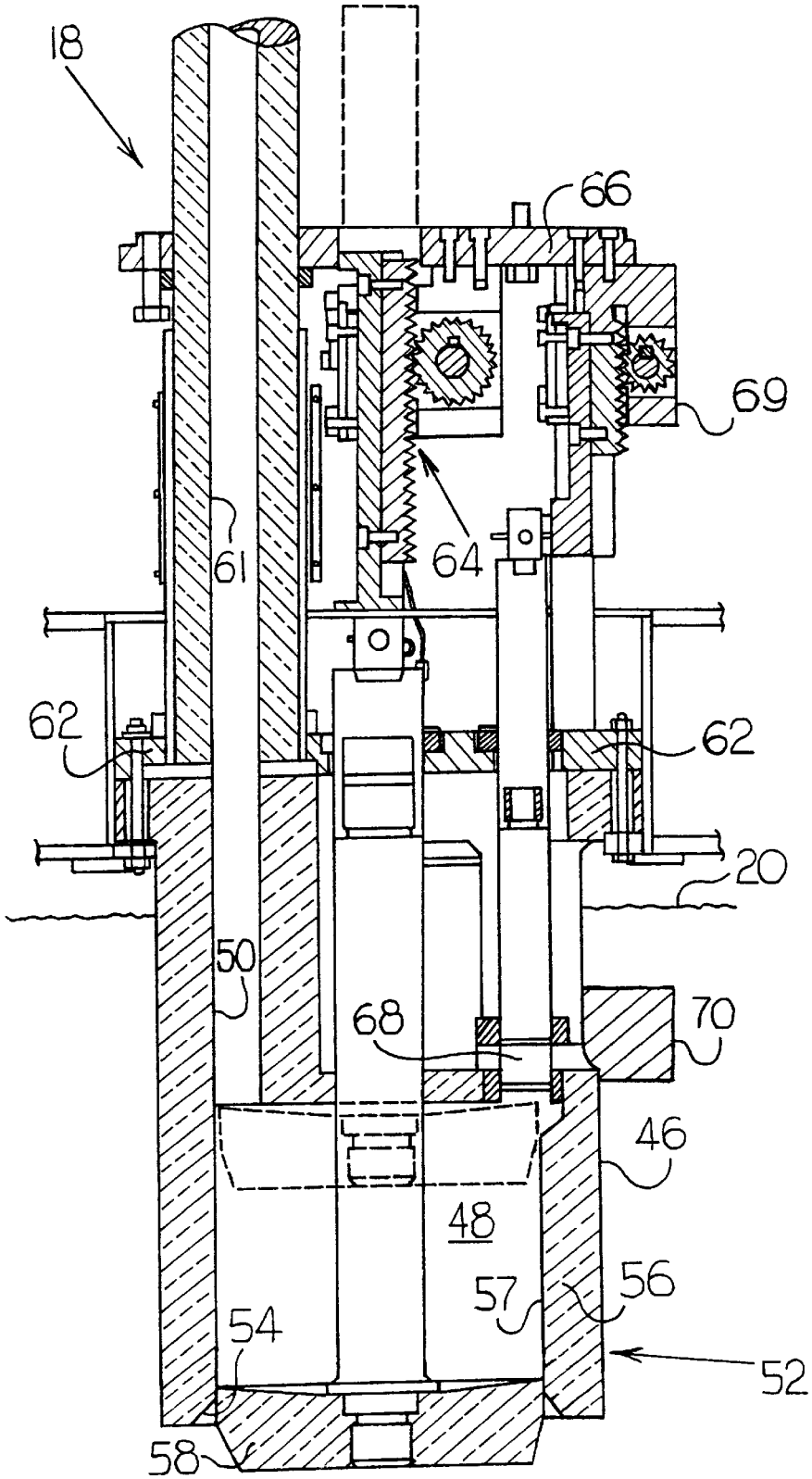
FIG. 2 is a front cross-sectional view of an injector for the molten metal injector system of FIG. 1 according to a first embodiment of the present invention.
Figure 3:
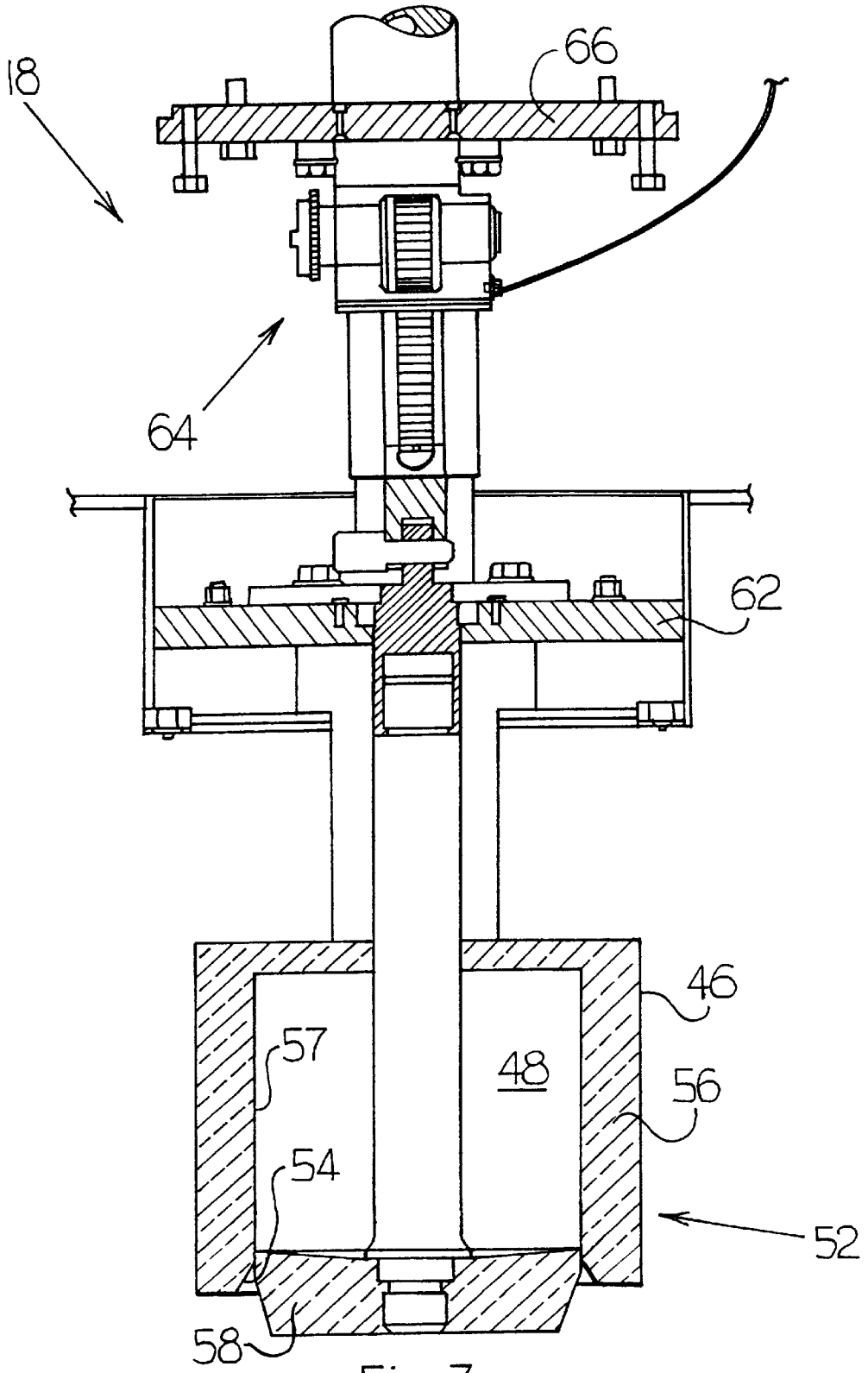
FIG. 3 is a side cross-sectional view of the injector of FIG. 2.

A piston 58 is positioned in and movable within the piston cavity 48. The piston 58 has substantially the same diameter as the piston cavity 48 and the, tapered inner surface 54 has a slightly larger diameter than the piston 58. In particular, the piston 58 is movable in a reciprocating manner within the piston cavity 48 through a downstroke and a return stroke. FIG. 2 illustrates the piston 58 at a substantially full downstroke position in solid lines, and illustrates a full return stroke position of the piston 58 in broken lines. At the substantially full downstroke position of the piston 58, the piston 58 preferably remains in contact with the inner surface 57 of the cylinder 46 and prevents inflow of molten metal 14 into the piston cavity 48 at the lower end 52 of the cylinder 46. The total distance the piston 58 may extend downward may be controlled by a PLC controlling the servomotors powering the lifting mechanism attached to the piston 58, as discussed hereafter. During the return stroke position of the piston 58, the piston 58 may close off the fill conduit 50 from the piston cavity 48 as illustrated in broken lines in FIG. 2. The cylinder 46 and the piston 58 are preferably made of a material compatible with molten aluminum alloys. In particular, suitable materials for the cylinder 46 and the piston 58 include graphite and high quality ceramic compounds, such as Sialon and $Si_3N_4$. Additionally, other suitable materials compatible with molten aluminum alloys include blends of $ZrO_2$ and BN. Further, the present invention envisions the use of both graphite and high quality ceramic compounds for the cylinder 46 and the piston 58.

Preferably; the piston 58 is oriented substantially perpendicular to the bottom side 44 of the casting mold 16. Hence, during the downstroke of the piston 58, the piston moves in a direction away from the bottom side 44 of the casting mold 16, and during the return stroke of the piston 58 it moves upward toward the bottom side 44 of the casting mold 16. A fill tube 61 is connected to the fill conduit 50 by a connecting flange 62 and passes through the bottom side 44 of the casting mold 16. In particular, the fill tube 61 extends through a vertical opening in the holder frame 28 and the lower die 30. The fill tube 61 places the piston cavity 48 in fluid communication with the mold cavity 34. The fill tube 61 may be made of materials similar to those used for the cylinder 46 and the piston 58.

The piston 58 is movable through the downstroke and the return stroke by a lifting mechanism 64 that is fixed to the cylinder 46 by the connecting flange 62, which is also used to connect the fill tube 61 to the fill conduit 50. The lifting mechanism 64 is preferably a rack and pinion as shown, but may also be a chain drive. With the cylinder 46 substantially submerged in the molten metal 14 contained in the holding furnace 12, the lifting mechanism 64 is located above the metal oxide film surface 20 of the molten metal 14. In particular, the lifting mechanism 64 is preferably located about fourteen inches above the metal oxide film surface 20 of the molten metal 14 contained in the holder furnace 12 when the holder furnace 12 contains the molten metal 14. The lifting mechanism 64 and, hence, the injector 18 are fixed to the bottom side 44 of the casting mold 16 by an upper flange 66. The lifting mechanism 64 may be connected to the upper flange 66 by mechanical fasteners, i.e., bolts. Similarly, the upper flange 66 may be fixed to the bottom side 44 of the casting mold 16 by mechanical fasteners, i.e., bolts. Thus, the injector 18 is attached to the lower die 30 of the casting mold 16 via the flange 66 and structural connections between the flange 66 and the connecting flange 62.

Due to the close proximity of the lifting mechanism 64 to the holder furnace 12, the lifting mechanism 64 is subjected to high temperatures and is preferably made of a material capable of withstanding temperatures on the order of 600–1000° F. Suitable materials for the lifting mechanism 64 include those previously discussed that are compatible with molten aluminum.alloys, as well as steel and other ferrous materials since the lifting mechanism 64 does not directly contact the molten metal 14. The rack and pinion comprising the lifting mechanism 64 may be driven by a remotely controlled servomotor (not shown). The servomotor may be controlled by a PLC. The PLC may be programmed to adjust the vertical distance the piston 58 may travel during its downstroke.

A valve 68 is connected to the cylinder 46 for receiving the molten metal 14 into the injector 18. Hence, the valve 68 operates as the molten metal intake to the injector 18. The valve 68 is preferably connected to the cylinder 46 such that with the cylinder 46 at least partially submerged in the molten metal 14 contained in the holding furnace 12, the valve 68 is completely submerged in the molten metal 14 and located below the metal oxide film surface 20 of the molten metal 14. In particular, in a preferred embodiment of the injector 18 the valve 68 is located about fourteen inches below the metal oxide film surface 20 of the molten metal 14, when the holder furnace 12 is filled with the molten metal 14. The valve 68 is in fluid communication with the piston cavity 48 and is configured to open at the beginning of the downstroke of the piston 58 and close during the return or pumping stroke of the piston 58. The valve 68 preferably opens fully when the piston 58 begins its downstroke and closes fully when the piston 58 reaches its substantially full downstroke piston. The valve 68 remains closed during the return or pumping stroke of the piston 58, thereby sealing off the piston cavity 48. The opening and the closing of the valve 68 is controlled by a valve controller 69. The valve controller 69 may be a rack and pinion operatively connected to the valve 68. The rack and pinion forming the valve controller 69 may be driven by a remotely controlled servomotor. A molten metal filter 70 may be used to cover the inlet to the valve 68 to filter and remove debris from the molten metal 14 flowing into the piston cavity 48 through the valve 68. In addition to molten metal filtration, the molten metal filter 70 may regulate the flow of molten metal 14 into the piston cavity 48 so that there is no initiation of turbulent molten metal flow into the piston cavity 48. The lifting mechanism 64 controlling the piston 58 may be set to allow the piston 58 to form a gap with the tapered inner surface 54 of the cylinder 46, which permits the molten metal contained in the piston cavity 48 to drain from the piston cavity 48 when it is time to perform routine maintenance on the injector 18, or replace the injector 18.

Figure 5:
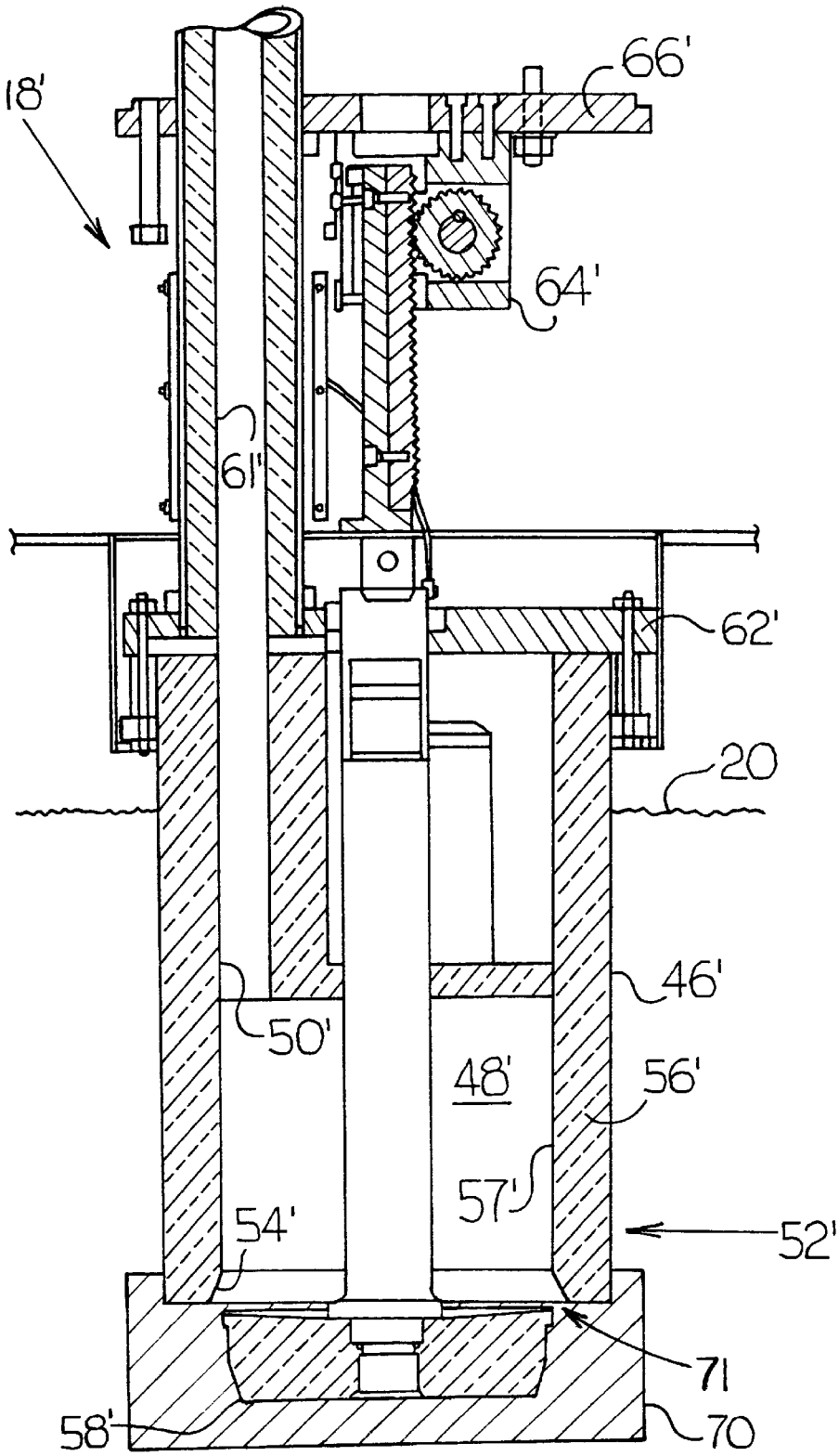
FIG. 5 is a cross-sectional view of an injector for the molten metal injector system of FIG. 1 according to a second embodiment of the present invention.

FIG. 5 shows a second embodiment of the injector according to the present invention and designated with reference numeral 18'. The injector 18' shown in FIG. 5 is substantially identical to the injector 18 shown in FIGS. 1–4, but now the valve 68 is omitted from the injector 18'. The molten metal intake to the piston cavity 48' is now defined entirely by a gap 71 formed between the piston 58' and the tapered inner surface 54' of the cylinder 46' when the piston 58' is extended to the substantially full downstroke position. The size of the gap 71 may be adjusted by adjusting the lifting mechanism 64', which controls the vertical distance the piston 58' may travel with respect to the cylinder 46'. Accordingly, in the injector 18', at the substantially full downstroke of the piston 58', the piston 58' extends below the end of the cylinder 46' which permits the gap 71 to be formed between the piston 58' and the tapered inner surface 54' of the cylinder 46'. The piston land of the piston 58' may also be shortened to facilitate formation of the gap 71 between the piston 58' and the tapered inner surface 54' of the cylinder 46'. In FIG. 5, the piston 58' is shown at a full downstroke position where the gap 71 is approximately at a maximum and the rate of inflow of molten metal into the piston cavity 48' through the gap 71 would be approximately at a maximum. A molten metal filter 70' may be attached to the lower end 52' of the cylinder 46'. For example, the molten metal filter 70' may be provided as a sleeve extending downward sufficiently from the lower end 52' of the cylinder 46' such that the piston 58' may extend downward to its full downstroke position. The molten metal filter 70' is used to filter the molten metal 14 and further, may be used to regulate the flow of molten metal into the piston cavity 48' so that initiation of turbulent molten metal flow into the piston cavity 48' through the gap 71 is minimized.

Figure 6:
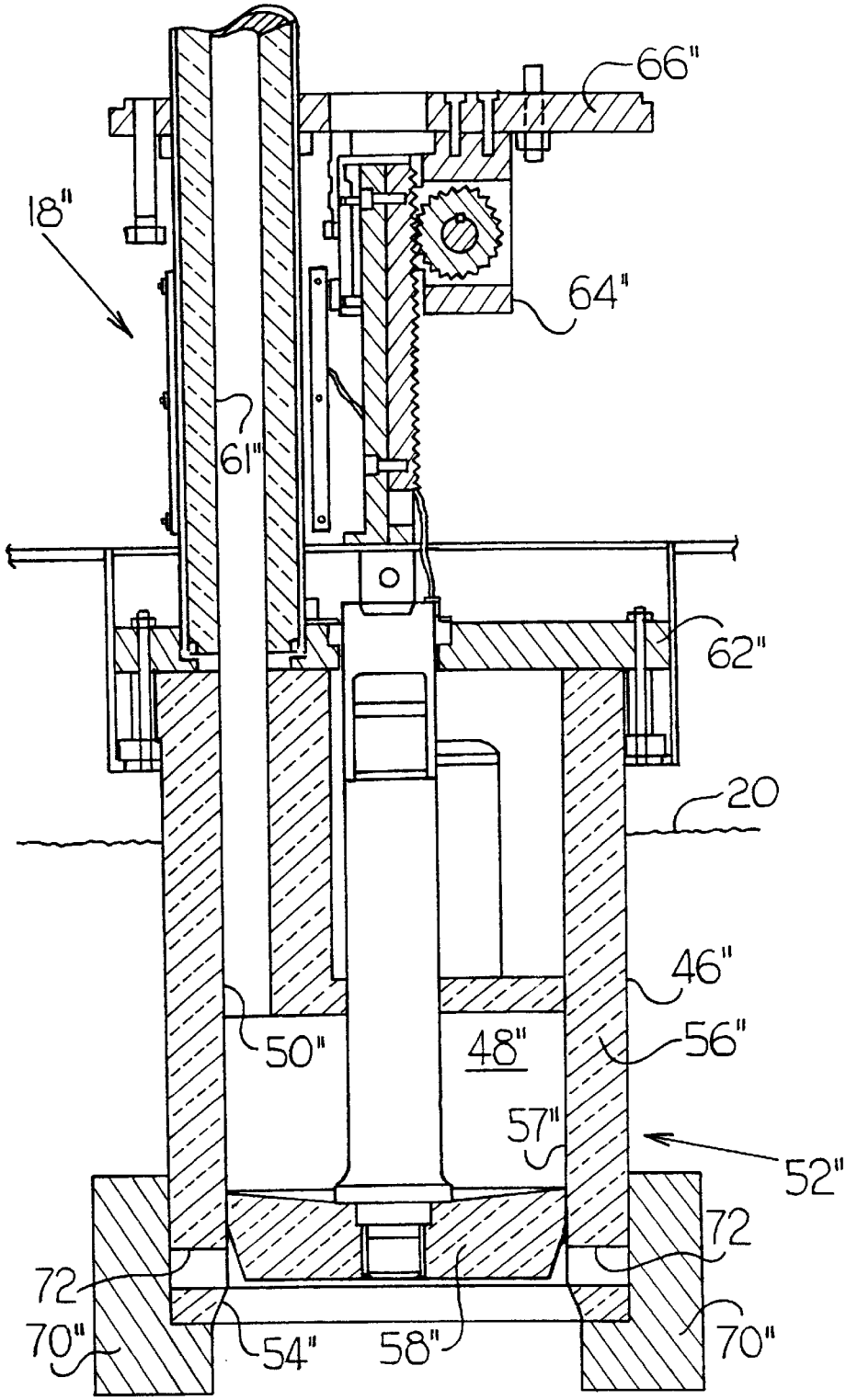
FIG. 6 is a cross-sectional view of an injector for the molten metal injector system of FIG. 1 according to a third embodiment of the present invention.

FIG. 6 shows a third embodiment of the injector according to the present invention and designated with reference numeral 18". The injector 18" shown in FIG. 6 is substantially identical to the previously discussed injectors 18, 18', but further includes two apertures 72 formed in the sidewall 56" of the cylinder 46". The apertures 72 are formed adjacent the tapered inner surface 54" of the cylinder 46". The injector 18" in FIG. 6 includes two apertures 72 formed in the cylinder 46", but it will be appreciated by those skilled in the art that at a minimum only one aperture 72 is necessary. In addition, the injector 18" may have more than two apertures 72 in accordance with the present invention. The piston land of the piston 58" is formed similar to the piston land of the piston 58 for the injector 18 of FIG. 2. The apertures 72 are each covered by a molten metal filter 70" for filtering and straining debris from the molten metal 14 as the molten metal 14 flows through the apertures 72 and into the piston cavity 48". The molten metal filter 70" may be further used to regulate the flow of molten metal 14 into the piston cavity 48" so that initiation of turbulent molten metal flow into the piston cavity 48" through the apertures 72 is minimal. The apertures 72 are located in the sidewall 56" of the cylinder 46" such that the apertures 72 are open for inflow of the molten metal into the piston cavity 48" when the piston 58" is in the substantially full downstroke position. The apertures 72 begin to open for inflow of the molten metal 14 into the piston cavity 48" as the piston 58" approaches the substantially full downstroke position. At the substantially full downstroke position of the piston 58", the piston 58" preferably remains in contact with the inner surface 57" of the cylinder 46" and prevents inflow of molten metal 14 into the piston cavity 48" at the lower end 52" of the cylinder 46" when the piston reaches the substantially full downstroke position. Hence, the apertures 72 are the molten metal intake to the piston cavity 48". As the piston 58" begins its return stroke, the outer circumferential edge of the piston 58" remains substantially with the inner surface 57" of the cylinder 46". The lifting mechanism 64" may be adjusted to allow the piston 58" to extend below the end of the cylinder 46" such that a gap forms which provides an egress point for molten metal when the injector 18" requires maintenance or replacement.

Referring now to FIGS. 1–4, operation of the injector 18 through a downstroke and return stroke cycle of the piston 58 will now be discussed. As stated previously, the injector 18 is supported from the bottom side 44 of the casting mold 16. The cylinder 46 and the piston 58 are substantially submerged in the molten metal 14 contained in the holding furnace 12. As the piston 58 begins its downstroke, the valve 68 opens and permits the molten metal 14 to flow into the piston.cavity 48. As the piston 58 moves through its downstroke, the molten metal 14 continues to flow into the piston cavity 48 through the valve 68 and the molten metal filter 70, if present. After a predetermined period of time to allow the piston cavity 48 to fill with the molten metal 14, the valve 68 closes and the lifting mechanism 64 is engaged to begin moving the piston 58 upward through its return stroke. The piston 58 may be controlled such that the piston cavity 48 may be entirely filled with molten metal 14 flowing through the valve 68 before the piston 58 reaches its substantially full downstroke position and before a gap forms between the piston 58 and the cylinder 46. The vertical distance traveled by the piston 58 is controlled by the lifting mechanism 64. The servomotors driving the lifting mechanism 64 and the valve controller 69 may be remotely controlled by a programmable logic computer (PLC) to control the distance the piston 58 travels and the opening and closing of the valve 68, as will be appreciated by those skilled in the art.

For example, a casting cycle may begin with the piston 58 at a downstroke position as shown in FIG. 2. At this point, the valve 68 is closed, the piston cavity 48 is completely filled with molten metal 14 and the lift mechanism's servomotor(s) controlled by the PLC begins the injection stroke (i.e., return stroke). This follows a pre-specified position versus time path. When molten metal 14 fills the mold cavity 34, pressure builds and the servomotor(s) can no longer follow a path versus distance relation and abruptly changes to a torque holding condition. After the torque holding condition is established, which reflects a pressure intensification of about 5 to 45 psi for a sufficient time for the molten metal 14 to solidify in the mold cavity 34, the valve 68 is opened and the piston 58 is slowly lowered to the start position (i.e., downstroke position). The piston 58 may be set to travel any vertical distance required and is not limited to traveling between the full downstroke and full return stroke positions depending he application at hand, as will be appreciated by those skilled in the art. In the case where no valve 68 is present, as shown in FIG. 5, the piston 58' is lowered sufficiently for molten metal to enter into the piston cavity 48' through the gap 71.

Referring again to FIGS. 1–4, as the piston 58 moves upward through its return stroke, the molten metal 14 now contained in the piston cavity 48 is pumped upward by the piston 58 from the holder furnace 12. The molten metal 14 flows through the fill conduit 50 and into the fill tube 61. The molten metal 14 in the fill conduit 50 and the fill tube 61 is injected under low pressure (i.e., less than about 15 psi) into the mold cavity 34. As the piston 58 reaches the substantially full return stroke position, for example, the lifting mechanism 64 is stopped. The piston 58 may be stopped prior to the full return stroke position if the torque holding condition occurs indicating that the mold cavity 34 is filled with the molten metal 14. A sensor (not shown) may be attached to the lifting mechanism 64 and used to sense when the piston 58 has reached the torque holding condition indicating the mold cavity 34 is filled with the molten metal 14. The sensor may be connected to the PLC controlling the lifting mechanism 64, for example.

The injector 18 of the present invention advantageously locates the valve 68 well below the metal oxide film surface 20 of the molten metal 14. Since the valve 68, i.e., the molten metal intake for the injector 18, is located well below the metal oxide film surface 20, the metal oxide film surface 20 remains substantially undisturbed as the molten metal 14 from the holder furnace 12 flows into the piston cavity 48 through the valve 68. As described previously, the valve 68 should be located about fourteen inches below the metal oxide film surface 20. This assures that any disturbances to the metal oxide film surface 20 are minimized and substantially prevents metal oxides from being introduced into the piston cavity 48 from the metal oxide film surface 20.

In addition, because the piston cavity 48 is filled during the downstroke of the piston 58 via the valve 68 this helps prevent the initiation of turbulent molten metal flow and thus formation of metal oxides in the piston cavity 48 due to the action of the piston 58. The difficulty with many prior art piston arrangements is that the pumping stroke of the piston 15 during the downstroke, which has a tendency to disturb the metal oxide film surface of the supply of molten metal which the piston operates, as well as create disturbances within the piston cavity which could cause metal oxides to form in the piston cavity . In the injector 18, the pumping stroke is the return stroke which minimizes the chances of forming metal oxides in the piston cavity 48, as well as minimizes the disturbances to the metal oxide film surface 20 of the molten metal 14 in the holder furnace 12. In addition, in the injector 18 the piston cavity 48 is gradually refilled during the downstroke of the piston 58 with the molten metal 14 slowly entering through the valve 68. The valve 68 permits the inflow of the molten metal 14 into the piston cavity 48 such that a vacuum is not generated in the piston cavity 48 which could pull atmospheric air into the fill tube 61 and the fill conduit 50 and further down into the piston cavity 48. This substantially prevents the formation of metal oxides within the piston cavity 48 due to the movement of the piston 58. A valve that regulates the rate of inflow of the molten metal 14 into the piston cavity may be used in place of the valve 68.

The injector 18 of the present invention may further include a source of inert gas 80, such as argon or nitrogen, in fluid communication with the fill tube 61. The source of inert gas 80 preferably supplies the inert gas through the lower die 30 or the upper die 32 and into the mold cavity 34. The inert gas 80 will flow down the fill tube 61 and fill conduit 50 and into the piston cavity 48. This prevents the introduction of atmospheric air into the fill tube 61, fill conduit 50 and the mold cavity 34 which could potentially form metal oxides in the piston cavity 48.

The injector 18' of FIG. 5 operates in a substantially similar manner to the injector 18 of FIGS. 1–4, with the exception that the molten metal 14 from the holder furnace 12 flows into the piston cavity 48' entirely through the gap 71 formed between the piston 58' and the tapered inner surface 54' of the cylinder 46' at the substantially full down position of the piston 58'. Accordingly, the molten metal intake to the piston cavity 48', the gap 71, is located well below the metal oxide film surface 20 of the molten metal 14 in this embodiment, and disturbances to the metal oxide film surface 20 of the molten metal 14 are minimized.

The injector 18" of FIG. 6 operates in a substantially similar manner to the injector 18 of FIGS. 1–4 and the injector 18' of FIG. 5, with the exception that with the piston 58" located in the substantially full downstroke position, the apertures 72 in the sidewall 56" of the cylinder 46" are open for inflow of the molten metal 14 into the piston cavity 48". The filters 70" covering the apertures 72 act to filter and strain debris from the molten metal 14 before passing through the apertures 72. As the piston 58" begins its return stroke, the apertures 72 begin to become closed-off by the piston 58". In this embodiment, because the apertures 72 are located well below the metal oxide film 20, disturbances to the metal oxide film surface 20 are minimized.

Figure 7:
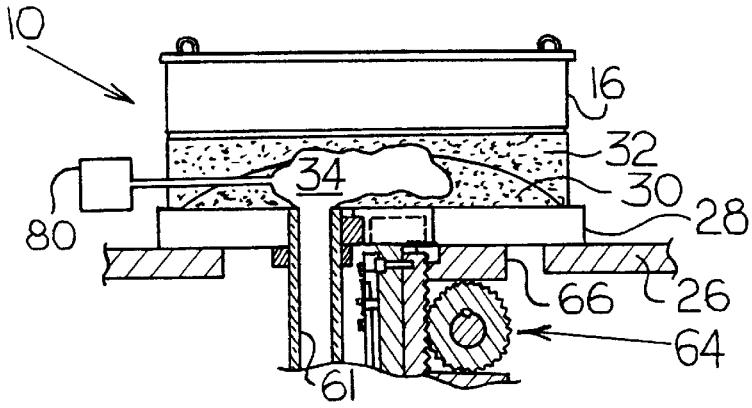
FIG. 7 is a partial cross-sectional side view of a casting mold and the injector used in the molten metal injector system of FIG. 1.
Figure 8:
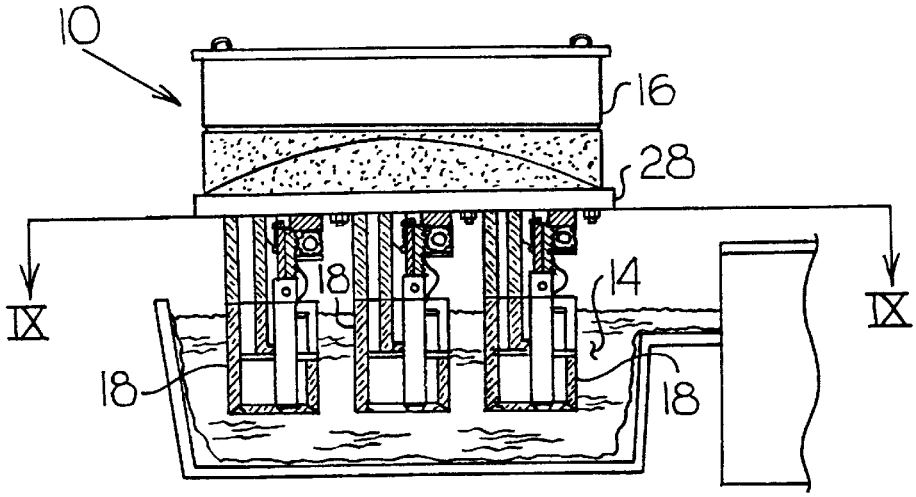
FIG. 8 is a side view of the molten metal injector system of FIG. 1 having multiple injectors in accordance with the present invention.
Figure 9:
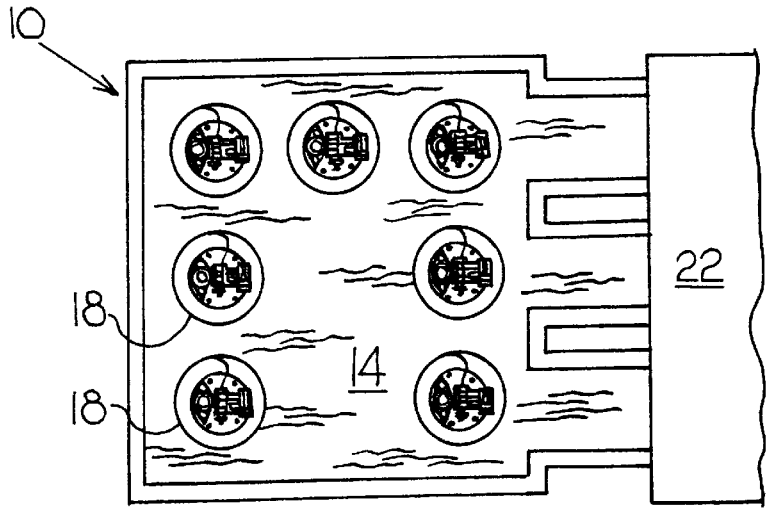
FIG. 9 is a cross-sectional plan view taken along lines IX—IX in FIG. 8.

As stated previously, the present invention envisions the use of a plurality of injectors 18 (or 18' or 18") suspended from the bottom side 44 of the casting mold 16, as show in FIG. 8. Referring now to FIGS. 7–9, the injectors 18 are preferably supported from the bottom side 44 of the mold 16 to optimize the inflow of the molten metal 14 into the mold cavity 34. FIG. 9 illustrates a possible configuration for arranging the injectors 18 to form a component piece for a ground transportation vehicle, such as a single piece lift gate for a minivan. In the arrangement of FIG. 9, seven injectors 18 are utilized, with the locations of the injectors 18 selected to optimize inflow of the molten metal 14 into the mold cavity 34 such that the molten metal 14 evenly fills the mold cavity 34 without the introduction of occlusions that may be formed by trapped air. The injectors 18 may be individually controlled by a programmable logic controller, for example, such that the injectors 18 inject the molten metal 14 at different rates and at different times as necessary to fill the mold cavity 34 to form the component.

In view of the foregoing, a method of injecting the molten metal into the mold cavity of the casting mold in accordance with the present invention may include the steps of: providing the supply of the molten metal; supporting the casting mold above the molten metal, with the bottom side of the mold facing the molten metal; supporting the molten metal injectors from the bottom side of the mold, with the injectors projecting into the holder furnace and providing fluid communication between the holder furnace and the mold cavity; and injecting the molten metal into the mold cavity with the injector such that the metal oxide film surface of the molten metal in the holder furnace remains substantially undisturbed. The method may further include the step of individually controlling the injectors to regulate the injection of the molten metal into the mold cavity of the mold. The injectors are operated such that metal oxides are substantially prevented from forming within the piston cavity for each of the injectors. The step of injecting the molten metal from the supply of molten metal into the mold cavity preferably occurs while the piston for each of the injectors is moving in the return stroke. The method according to the present invention may further include the step of supplying inert gas from the source of inert gas to the piston cavity for each of the injectors, when the piston for each of the injectors is moving in the downstroke. Furthermore, the method of the present invention may include the step of allowing inflow of the molten metal to the cylinder with the valve for each of the injectors, when the piston for each of the injectors is moving in the downstroke.

The injector system of the present invention provides a simplified apparatus and method for casting inexpensive, but high quality thin-walled components. The injector system of the present invention may be applied to cast complex components as a single piece, which could be used to replace stamping assemblies made from multiple stamped components. In addition, the injector system of the present invention generally overcomes the previously discussed deficiencies with the prior art. For example, the injector system includes a piston which pumps molten metal during its return stroke and receives molten metal during its downstroke. In addition, the molten metal intake in the injector system is located well below the metal oxide film surface of the molten metal. Consequently, during filling of the piston cavity the metal oxide film surface of the molten metal remains substantially undisturbed.

While the preferred embodiments of the present invention were described herein, various modifications and alterations of the present invention may be made without departing from the spirit and scope of the present invention. The scope of the present invention is defined in the appended claims and equivalents thereto.

We claim:

1. A molten metal injector system, comprising:

a holder furnace for containing a supply of molten metal having a metal oxide film surface;

a casting mold supported above the holder furnace and having a bottom side facing the holder furnace, with the mold defining a mold cavity for receiving the molten metal from the holder furnace; and a molten metal injector supported from the bottom side of the mold and projecting into the holder furnace, with the injector in fluid communication with the mold cavity and including a cylinder defining a piston cavity and a piston positioned within the piston cavity for pumping the molten metal upward from the holder furnace and injecting the molten metal directly into the mold cavity, wherein the cylinder further includes a molten metal intake for receiving the molten metal into the piston cavity, wherein the molten metal intake is located to be below the metal oxide film surface of the molten metal when the holder furnace contains the molten metal, wherein the piston is movable through a downstroke and a return stroke, and wherein the molten metal intake is a gap formed between the piston and an open end of the cylinder during the downstroke of the piston.

2. The injector system of claim 1, wherein the molten metal intake is located sufficiently below the metal oxide film surface when the holder furnace contains the molten metal such that the metal oxide film surface remains substantially undisturbed during pumping of the molten metal from the holder furnace to the mold cavity.

3. The injector system of claim 1, wherein the piston is oriented substantially perpendicular to the bottom side of the mold, and wherein the injector further includes a lifting mechanism positioned above the metal oxide film surface when the holder furnace contains the molten metal and operatively connected to the piston for moving the piston through the downstroke and the return stroke.

4. The injector system of claim 3, wherein the lifting mechanism is a rack and pinion.

5. The injector system of claim 1, wherein the intake is configured to open during the downstroke of the piston and permit inflow of the molten metal into the piston cavity when the holder furnace contains the molten metal, and wherein the piston is configured during the return stroke to pump the molten metal received in the piston cavity upward to the casting mold and inject the molten metal into the mold cavity under pressure.

6. The injector system of claim 1, wherein the open end of the cylinder is enclosed by a molten metal filter for filtering the molten metal flowing into the piston cavity through the gap.

7. The injector system of claim 1, wherein the piston and the cylinder are made of a material compatible with molten aluminum alloys.

8. The injector system of claim 1, wherein the piston cavity is in fluid communication with the mold cavity through a fill tube connected to the fill conduit and passing through the bottom side of the mold.

9. The injector system of claim 8, further including a source of inert gas in fluid communication with the fill tube such that during the downstroke of the piston, the piston cavity is filled with inert gas flowing down the fill tube and fill conduit.

10. An injector for injecting molten metal into a mold cavity of a casting mold, comprising:

a cylinder for at least partially submerging in a supply of molten metal, with the cylinder defining a piston cavity, and with the cylinder having an open end;

a fill conduit in fluid communication with the piston cavity;

a piston positioned within the piston cavity and movable through a downstroke and a return stroke, with the piston configured to form a gap with the open end of the cylinder during a downstroke of the piston; and a lifting mechanism fixed to the cylinder and operatively connected to the piston for moving the piston through the downstroke and the return stroke, wherein the gap is configured to permit inflow of molten metal into the piston cavity during the downstroke of the piston when the cylinder and piston are at least partially submerged in the supply of molten metal, and wherein the piston is configured during the return stroke to pump the molten metal received in the piston cavity into the fill conduit for injection into the mold cavity when the cylinder and piston are at least partially submerged in the supply of molten metal.

11. The injector of claim 10, further including a molten metal filter enclosing the open end of the cylinder for filtering the molten metal flowing into the piston cavity through the gap.

12. The injector of claim 11 wherein the piston and cylinder are made of a material compatible with molten aluminum alloys.

13. The injector of claim 10 wherein the lifting mechanism is a rack and pinion.

* * * * *

UNITED STATES PATENT AND TRADEMARK OFFICE

CERTIFICATE OF CORRECTION

PATENT NO. : 6,540,008 B1
DATED : April 1, 2003
INVENTOR(S) : Thomas N. Meyer et al.

It is certified that error appears in the above-identified patent and that said Letters Patent is hereby corrected as shown below:

Column 5,
Line 22, “furnace .12.” should read -- furnace 12. --
Line 58, “and the, tapered” should read -- and, the tapered --.

Column 6,
Line 17, “Preferably; the” should read -- Preferably, the --.
Line 60, “aluminum.alloys” should read -- aluminum alloys --

Column 8,
Line 41, “substantially with” should read -- substantially engaged with --.
Line 55, “piston.cavity” should read -- piston cavity --

Column 9,
Line 24, “depending he application” should read -- depending on the application --.

Column 14,
Line 3, “of claim 11” should read -- of claim 10 --.
Line 6, after “of claim 10” insert comma -- , --.

Signed and Sealed this

Twenty-eighth Day of October, 2003

JAMES E. ROGAN
*Director of the United States Patent and Trademark Office*